United States Patent [19]

von dem Bussche et al.

[11] 4,319,826

[45] Mar. 16, 1982

[54] PROCESS AND APPARATUS FOR DEVELOPING A TWO-COMPONENT DIAZOCOPYING MATERIAL

[75] Inventors: Götz von dem Bussche, Schwalbach; Jochen Koblo, Wiesbaden, both of Fed. Rep. of Germany

[73] Assignee: Hoechst Aktiengesellschaft, Frankfurt am Main, Fed. Rep. of Germany

[21] Appl. No.: 137,416

[22] Filed: Apr. 4, 1980

[30] Foreign Application Priority Data

Apr. 11, 1979 [DE] Fed. Rep. of Germany ..... 2914774

[51] Int. Cl.[3] ..... G03D 7/00

[52] U.S. Cl. ..... 354/299; 354/300; 430/150

[58] Field of Search ..... 354/299, 300; 355/27, 355/100, 106; 34/36, 37, 155, 234; 430/150

[56] References Cited

U.S. PATENT DOCUMENTS

| | | | |
|---|---|---|---|
| 4,003,069 | 1/1977 | Hilgers | 354/299 |
| 4,062,031 | 12/1977 | Schroter | 354/299 |
| 4,099,868 | 7/1978 | Schroter et al. | 355/106 |
| 4,135,814 | 1/1979 | Schroter et al. | 355/106 |
| 4,172,652 | 10/1979 | Stein | 354/300 |
| 4,181,420 | 1/1980 | Blume et al. | 354/299 |

FOREIGN PATENT DOCUMENTS

| | | | |
|---|---|---|---|
| 611428 | 3/1935 | Fed. Rep. of Germany . | |
| 862259 | 1/1953 | Fed. Rep. of Germany | 354/300 |
| 2244422 | 3/1974 | Fed. Rep. of Germany . | |
| 2417979 | 11/1974 | Fed. Rep. of Germany . | |
| 2726240 | 2/1978 | Fed. Rep. of Germany . | |
| 2659486 | 12/1978 | Fed. Rep. of Germany . | |
| 1463686 | 2/1977 | United Kingdom | 354/300 |

OTHER PUBLICATIONS

Offenlengungschrift 2534352, Published 3/2/77, pp. 1–23.

Auslegeschrift 2659486, Published 4/13/78, pp. 1–16.

*Primary Examiner*—L. T. Hix

*Assistant Examiner*—Alan Mathews

*Attorney, Agent, or Firm*—Schwartz, Jeffery, Schwaab, Mack, Blumenthal & Koch

[57] ABSTRACT

Disclosed is a process for developing a two-component diazocopying material, comprising the steps of providing a film of an ammonia-steam mixture or of an aqueous ammonia solution, respectively, flowing uniformly into the interior of an evaporation zone and being uniformly heated at the same time to release a developing gas in the evaporation zone; providing a liquid developing solution in a sump zone; evaporating a portion of the developing solution to produce a developing gas in the evaporation zone located above the sump zone, passing the diazocopying material through a developing zone; introducing the developing gas from the evaporation zone into the developing zone and contacting the diazocopying material with the developing gas in the developing zone; maintaining the temperature in the developing zone at a level higher than the temperature at which the developing gas enters from the evaporation zone; and maintaining the temperature in the sump zone at a level higher than the temperature in the evaporation zone but not exceeding the temperature in the developing zone. Also disclosed is an apparatus for carrying out this process.

15 Claims, 3 Drawing Figures

PROCESS AND APPARATUS FOR DEVELOPING A TWO-COMPONENT DIAZOCOPYING MATERIAL

BACKGROUND OF THE INVENTION

The present invention relates to a process for developing a two-component diazocopying material with a gas which has been released by evaporation of a developing liquid, more especially an aqueous ammonia solution. In particular, the gas is an ammonia-steam mixture. In this process, the temperature in the developing zone is higher than the temperature of admission from the evaporation zone. Furthermore, the invention relates to an apparatus for carrying out this process.

When a copying material of this type is developed with an ammonia-steam mixture, the general procedure consists in leading the copying material through a developing zone at the bottom of which an evaporator is arranged. A developing liquid is dripped into the evaporator, and the developing gas is released out of the developing liquid by the action of heat. It is a disadvantage that part of the steam which is in the developing gas precipitates on the conveyor belt or on the conveyor rolls as well as on the copying material. The condensed water can moisten the copying material and loosen the binding agent of the light-sensitive layer. As a result, the copying material can possibly stick to the structural parts of the developing zone and can cause break-down and jamming.

The process mentioned in the first paragraph, which is known from German Offenlegungsschrift No. 2,417,979, is intended to solve this disadvantage. In this process, the concentration of the developing gas can be maintained at a constant value, and the developing gas does not condense in the developing zone. The process is suitably carried out in such a way that the entering temperature of the admitted developing gas as well as the temperature of the developing zone are kept at a constant value or in such a way that both temperatures vary according to the same function. The known apparatus for carrying out this process comprises a vessel which contains the developing liquid and a developing zone which is provided with a heater and which can be closed. The developing zone is linked to the vessel by pipe-lines. A pump and a gas-expelling chamber which is provided with a heater, are connected to the developing zone. The heater of the developing zone is connected to a first temperature control device, the heater of the gas-expelling chamber is connected to a second temperature control device, and the set point of the first temperature control device is set higher than the set point of the second temperature control device.

In another known process according to German Pat. No. 2,726,240 for the dry development of two-component diazocopying material, in particular polyester-based microfilm-duplicating film, the diazocopying material passes at atmospheric pressure through an ammonia-steam mixture, containing 3–25% by weight of ammonia, at a temperature between about 105° and 120° C. Before the developing atmosphere, the diazocopying material is exposed to a predeveloping atmosphere at a temperature between 100° and 110° C.; the predeveloping atmosphere contains 20 to 80% of the ammonia concentration of the developing gas atmosphere. The apparatus for carrying out this process comprises a developing chamber provided with at least one heating installation which is connected by a temperature control device to a thermometer probe arranged in the developing chamber. The temperature control device is adapted to a set point between 105° and 120° C. At least one line opens into the developing chamber for feeding in the developer. A predeveloping chamber is arranged just before the developing chamber, and a restrictor is situated between these two chambers. The predeveloping chamber is linked to a suction device having a capacity, by means of which the developing gas, streaming in through the restrictor, maintains the ammonia-gas concentration in the predeveloping chamber between 70 and 80% of the ammonia-gas concentration in the developing chamber. The metering devices for the developer are proportioned in such a way that an ammonia-concentration of 3–25% by weight is maintained in the developing chamber. The predeveloping chamber is provided with a heating installation by means of which the predeveloping atmosphere is heated to a temperature between 100° and 110° C. In this developing apparatus, the ante-chambers contribute to a large extent to the development of the diazocopying material which passes through them. Thus the achieveable optical density of the developed diazocopying material is increased.

In the known processes and apparatuses, the expenditure on construction for obtaining a large optical density, for avoiding the precipitation of condensate on the structural parts inside the developing chamber, for lowering the ammonia portion in the spent air and for reducing the ammonia consumption is large and, hence, correspondingly expensive.

SUMMARY OF THE INVENTION

It is therefore an object of the present invention to provide an improved developing process for two-component diazocopying material.

It is also an object of the invention to provide such an improved process wherein the working conditions are more advantageous with a minimum of expenditure on construction than those of the known procedure, wherein the precipitation of condensate in the developing zone, the ammonia-consumption and the ammonia portion in the spent air are lowered, and wherein the residual ammonia is expelled of the waste water and led to the developing atmosphere.

It is also an object of the present invention to provide an improved apparatus for developing two-component diazocopying material, preferably according to the process of the invention.

In accomplishing the foregoing objects, there has been provided in accordance with the present invention a process for developing a two-component diazocopying material, comprising the steps of providing a film of an ammonia-steam mixture or of an aqueous ammonia solution, respectively, flowing uniformly into the interior of an evaporation zone and being uniformly heated at the same time to release a developing gas in the evaporation zone; providing a liquid developing solution in a sump zone, preferably an aqueous ammonia-containing solution; evaporating a portion of the developing solution to produce a developing gas in the evaporation zone located above the sump zone; passing the diazocopying material through a developing zone; introducing the developing gas from the evaporation zone into the developing zone and contacting the diazocopying material with the developing gas in the developing zone; maintaining the temperature in the developing zone at a level higher than the temperature at which the developing gas enters from the evaporation zone; and maintaining the temperature in the sump zone at a level higher than the temperature in the evaporation zone but not exceeding the temperature in the developing zone, preferably at a constant value without influencing the temperature in the developing zone and in the evaporation zone.

In accordance with another aspect of the present invention, there has been provided an apparatus for developing a two-component diazocopying material, comprising a developing chamber defining therein a developing zone; means for transporting a diazocopying material through the developing chamber, means associated with the developing chamber for maintaining a uniform temperature in the developing zone; and evaporator positioned below and adjacent to the developing chamber for producing a developing gas, this evaporator comprising an evaporation zone positioned in a heat-transfer relationship with the developing chamber in such a way that the temperature in the evaporation zone is slightly less than the temperature in the developing zone, and a sump zone positioned below the evaporation zone for containing a liquid developing solution; a conduit connecting the evaporator to the developing chamber for conveying developing gas from the evaporator into the developing zone; and means positioned at the bottom of the sump zone on the evaporator for heating the sump zone to a temperature which does not exceed the temperature in the developing zone.

Further objects, features and advantages of the present invention will become apparent to a person skilled in the art from the detailed description of preferred embodiments which follows, when considered together with the attached figures of drawing.

DETAILED DESCRIPTION OF PREFERRED EMBODIMENTS

Figure 1:
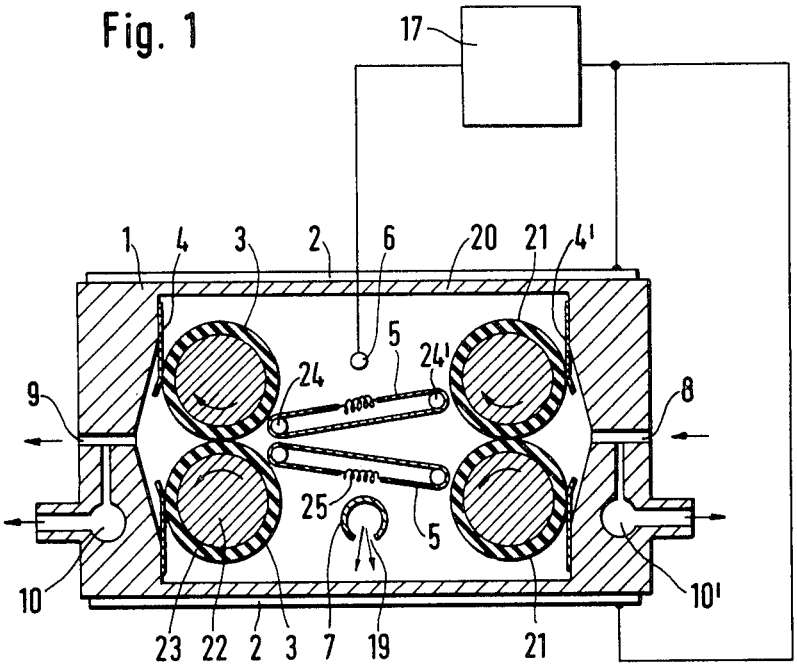
FIG. 1 is a longitudinal cross-sectional view of the developing apparatus according to the invention comprising the developing chamber and the evaporator.

According to the invention, the temperature in a sump zone below the evaporation zone is maintained at a higher level than the temperature in the evaporation zone and at a level which is lower than or equal to the temperature in the developing zone. It is of importance to maintain the temperature in the sump zone at a constant value without influencing the temperature in the developing zone and in the evaporation zone.

In a suitable embodiment of the process, the ambient temperature is from about 87°-90° C. in the developing zone, from about 83°-85° C. in the evaporation zone and from about 86°-90° C. in the sump zone.

The starting point for carrying out the process is the known apparatus as described above. According to the invention, this apparatus is designed in such a way that the sump zone of the evaporator is arranged below the evaporation zone and can be heated by an additional heating installation, situated at the bottom side of the evaporator, to a temperature lower than or equal to the temperature in the developing zone. Furthermore, the evaporator is linked to the developing chamber by means of an evaporation pipe and lies against the wall of the developing chamber in such a way that a heat transfer takes place through the wall of the developing chamber to the evaporator. The temperature is thus reduced up to 5° C. from the developing zone to the evaporation zone. Hence, the temperature in the evaporation zone is adapted by heat conduction through the wall of the developing chamber, so that it is rendered unnecessary to equip the evaporation zone with its own heating installation and a thermometer probe which is required for the heating installation, and a temperature control device with a setpoint adjustment. The additional heating installation for the sump zone is arranged in such a way that it only heats the waste water in the sump zone but does not influence the temperature in the evaporation zone and in the developing zone.

In one embodiment of the invention, the evaporation pipe of the evaporator leads horizontally from the evaporation zone into the developing chamber and has on its bottom side a continuous slot. Hence, it is ensured that the heated ammonia-steam mixture passes to the bottom of the developing chamber and does not immediately pass onto the diazocopying material, but covers it with mist.

As the temperature in the sump zone is higher than the temperature in the evaporation zone, the residual ammonia is expelled out of the waste water, with the ammonia passing from the sump zone through the evaporation zone into the developing zone. Because each of the input and output slots of the developing chamber is furthermore linked to a corresponding suction chamber, via which the excess ammonia is drawn off, no ammonia passes into the external space of the developing chamber. In this way, the ammonia sticking to the copying material-layer is also drawn off and led into an absorption-vessel.

Compared to known apparatuses, the ammonia consumption is considerably lowered as a result of the special seals on the front sides and on the surfaces of the conveyer rolls inside the developing chamber and as a result of the different temperatures in the evaporation zone, the sump zone and the developing zone. The use of very fine-meshed fabric webs, made of polyamide fabric, as guiding elements for the copying material contributes to the reduction of the ammonia content outside the developing chamber. These meshes hold back possible impurities from the copying material, which normally cause scratches on the roll-surfaces and hence reduce the sealing of the developing chamber from the external space, so that ammonia-gas can escape from the chamber. Hence, the consumption of ammonia is also lowered since a larger amount of ammonia must be fed into a permeable developing chamber for the development process than into an impervious chamber.

Figure 2:
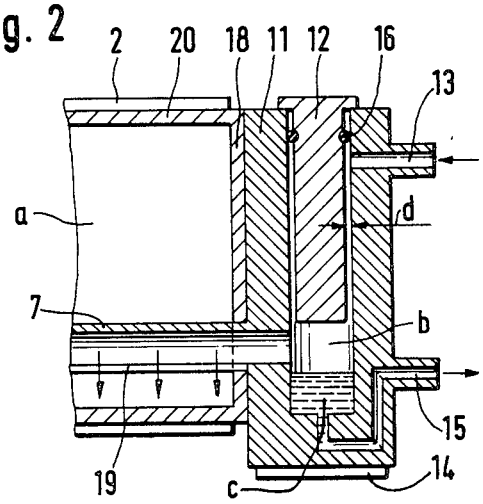
FIG. 2 is a partial lateral cross-sectional view of the developing apparatus according to FIG. 1, showing the evaporator.

Referring now to the drawings, FIGS. 1 and 2 illustrate an apparatus for carrying out the process according to the invention. This apparatus comprises essentially a developing chamber 1 and an evaporator 11, which is arranged at the side of the developing chamber, as is shown in section in FIG. 2. The copying material enters the developing chamber 1 through the input slot 8 and leaves it through the output slot 9. The developing chamber 1 is sealed to a large extent from the outer atmosphere by a driven pair of feed rolls 21 and by a pair of discharge rolls 3 which are also driven. Together with the feed rolls 21, sealing lamellas 4' improve the sealing from the outer atmosphere. In the same way, sealing lamellas 4 rest against the discharge rolls 3 and seal them to a large extent from the outer atmosphere. Each of the rolls 21 and 3 consists of a metal core 22 which has a coating 23 of ammonia- and heat-proof silicone rubber. Up to 170° C., this silicone rubber is largely ammonia- and heat-proof, and compared to the usual rubber compounds for coatings of this kind which decompose and harden after awhile, it has a considerably increased lifetime. The sealing lamellas 4, 4' consist, for example, of lamellas made of spring steel having a thickness of 0.05 mm. These lamellas are coated or covered with Teflon or with a fabric made of silicone and glass fiber. Sealing lamellas 4, 4' which have this structure avoid damage of the roll surfaces which have to be free of scratches for an optimal sealing of the developing chamber 1 from the outer atmosphere. The roll sealings on the front sides, which are not illustrated, consist, for example, of a neoprene material, laminated with silicone-glass fiber fabric. A good sealing of the developing chamber 1 is a condition for a low ammonia consumption in the development of the diazocopying material in the apparatus according to the invention.

In the suction chambers 10, 10', the excess ammonia-steam mixture is drawn off and led into an absorption vessel which is not illustrated. The residual water in the evaporator 11 is also led into this absorption vessel. Citric acid, for example, can be used as the absorption agent.

The housing 20 of the developing chamber 1 is surrounded by a heating installation consisting of plate heaters 2. A thermometer probe 6 is arranged in the developing chamber 1; it is connected to a temperature control device 17 outside of the developing chamber 1. The temperature control device 17 is linked to the plate heaters 2 on the walls of the housing 20 of the developing chamber. Inside the developing chamber 1, a guiding device made of fabric webs 5 runs between the feed rolls 21 and the discharge rolls 3. These webs introduce the diazocopying material, coming from the feed rolls 21, into the slot between the discharge rolls 3. Each of these fabric webs is inclined with respect to the horizontal running direction of the diazocopying material and forms a closed loop which is led around two axles 24, 24'. The ends of the loop are linked by a spring 25. The fabric web 5 is tightened by the pulling action which the spring 25 has on it. The material for the fabric web is a polyamide fabric with up to 80 mesh/cm. This polyamide fabric carries the diazocopying material in a most gentle way without scratching it and takes up any impurities which are possibly on the copying material in its meshes. Thus, it is avoided that such impurities scratch the surface of the discharge rolls 3.

FIG. 2 provides a sectional view of the details of the evaporator 11, which is part of the developing apparatus. Preferably, the evaporator 11 is a cylinder and has in its cylindrical interior a displacement body 12 which has a coaxial arrangement with respect to the cylindrical interior. A distance d which is typically from about 0.5–5 mm, and in particular from about 1–3 mm, separates the displacement body 12 from the wall of the interior of the evaporator 11 and ensures that the ammonia-steam mixture which flows into the interior of the evaporator through a supply pipe 13, or an aqueous ammonia solution, forms a film on the cylindrical surface of the displacement body 12. This film flows uniformly into an evaporation zone b situated below and is at the same time heated uniformly. The displacement body 12 has close to its butt a cut-out for an O-ring seal 16, which lies tightly against the wall of the interior of the evaporator 11. The bottom edge of the displacement body 12 limits the evaporation zone b. The cylindrical interior of the evaporator 11 extends toward the bottom in a sump zone c, which is adjacent to the evaporation zone b and collects the waste water or the residual water in which ammonia is still dissolved. A water-discharge device 15 leads from the sump zone c to the absorption vessel, which is not illustrated and is linked, as already mentioned above, to the suction chambers 10, 10'. At the level of the evaporation zone b, an evaporation pipe 7 leads horizontally into the developing chamber. The evaporation pipe 7 has on its bottom side a continuous slot 19 which is pointed downwardly toward the heated bottom of the developing chamber. The heated ammonia-steam mixture which leaves the evaporation pipe 7 strikes the bottom of the developing chamber 1 on which a deposit of lime and other constituents of the water can precipitate after a longer operating time. The exit direction of the ammonia-steam mixture has the advantage that the mixture covers the diazocopying material with a condensate in the form of a mist, instead of striking it directly and damaging the film-layer of the material.

An additional heating installation 14 is arranged at the bottom side of the evaporator 11. It maintains the temperature of the sump zone c at a level which is lower than or equal to the temperature in the developing zone a, but is higher than the temperature in the evaporation zone b. Thus, the temperature in the sump zone c is maintained at a constant level, preferably as a result of continuous heating by means of the additional heating installation 14, without influencing the temperatures in the developing zone a and in the evaporation zone b by this additional heating installation 14. The preferred temperatures are within the range from about 86°–90° C. in the sump zone c, from about 87°–90° C. in the developing zone a and from about 83°–85° C. in the evaporation zone. The temperature in the developing zone a is controlled by means of the thermometer probe 6 and the temperature control device 17 which is adjusted to the desired set point. The evaporator 11 lies against the wall 18 of the developing chamber 1 and obtains the heat which is necessary for adapting the temperature in the evaporation zone b by heat conduction through this wall 18. The wall 18 and the cylindrical body of the evaporator 11 are designed in such a way that the temperature in the evaporation zone b is up to 5° C. lower than in the developing zone a of the developing chamber 1. This difference in temperature is due to the heat transfer through the wall 18. As the temperature in the evaporation zone b is lower than the temperature in the developing zone a, no precipitate is formed in the developing zone on the diazocopying material. As a consequence of this kind of temperature adjustment, the temperature control advantageously takes place in only one point, i.e., the heating installation of the developing chamber 1 which is controlled by the thermometer probe 6 in combination with the temperature control device 17. No control is required for the additional heating installation 14, which is working continuously with a constant capacity, the capacity being determined and adjusted at the beginning of the developing process. Compared to the temperature in the evaporation zone b, the higher temperature in the sump zone c expels the residual ammonia out of the waste water and leads it to the developing zone a, with the efficiency of the ammonia for the development being increased thereby. The content of the residual ammonia in the waste water is lowered to a value below 3% by the additional heating installation. The waste water is then, as already mentioned, led through the water-discharge device 15 into the absorption vessel, which is not illustrated.

Figure 3:
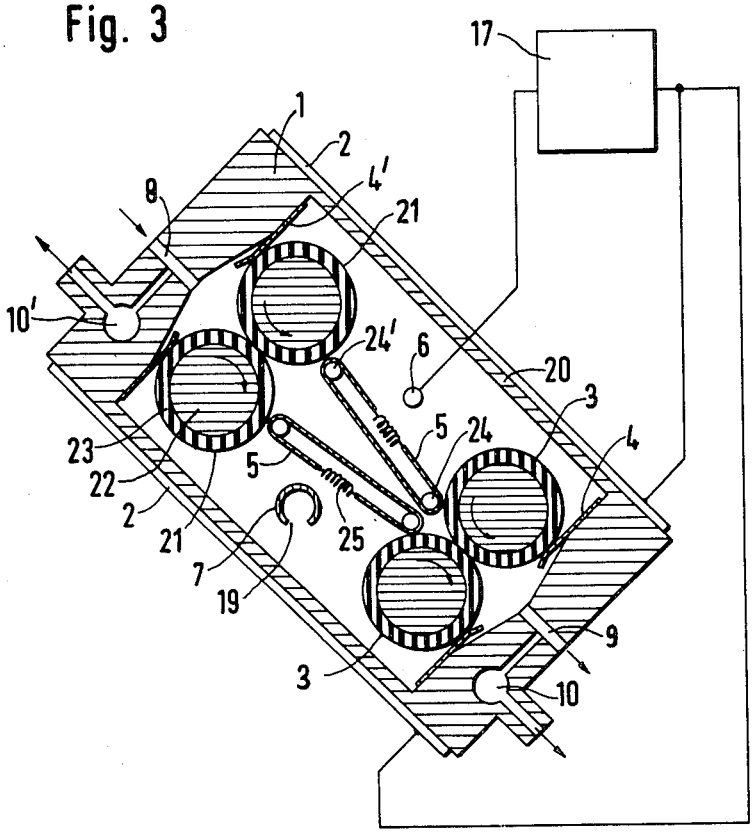
FIG. 3 is a longitudinal cross-sectional view of the developing apparatus according to FIG. 1, in which the developing chamber has an inclined position and the evaporator has a vertical position.

FIG. 3 shows diagrammatically that the developing chamber 1 does not necessarily have a horizontal position, but can as well be inclined, if the construction requires this position for adapting the course of the diazocopying material through the developing apparatus. The inclination of the developing chamber 1 does not affect the evaporator 11, as the latter remains in a vertical position and only the exit of the ammonia-steam mixture out of the slot 19 of the evaporation pipe 7 takes place at an angle to the nottom of the developing chamber 1. The evaporator 11 can be fixed to the wall 18 in a suitable manner, which is not illustrated in the drawing, whereby it is ensured that the evaporator 11 is always vertical even if the developing chamber 1 is placed into different positions.

When the process according to the present invention was carried out with the apparatus described above, only 70 ml/h of 25% ammonia solution was necessary for an hourly copying output of more than 1200 microfiche. This quantity can be reduced still more to 30 ml/h by a corresponding "stand-by" device, since this device stops the pump which conveys the ammonia or a corresponding aqueous ammonia-solution through supply pipe 13 to the evaporator 11 after a period of three minutes during which no copying pulse is received. At an operating time of 8 hours per day, and with the indicated copying output, 6 liters of ammonia are sufficient for one month of operation. It is evident that the gas quantity in the outer chamber of the developing chamber 1, which is to be absorbed, is correspondingly low.

An illustrative embodiment of the developing apparatus according to the present invention has the following technical data:

The heating installation of the developing chamber 1 comprises two plate heaters, each of which has a regulated input of 300 W at 220 V AC. The additional heating installation 14 operates with 50 W at 220 V AC. An NTC-rheostat is used as the thermometer probe 6 and is available to control a current up to 6 Amp via the control device 17. The difference in temperature $\Delta T$ from the selected set point can extend up to 2° C. An ammonia-steam mixture with 15–25% by weight of ammonia is used. For this purpose, 120 ml/h of ammonia are led to the evaporator 11, if the ammonia-steam mixture contains 15% by weight of ammonia; 70 ml/h of ammonia are led to the evaporator 11, if the ammonia-steam mixture contains 25% by weight of ammonia. The heating of the ambient temperature to 88° C. requires 10 minutes, and after a total of 15 minutes, the developing apparatus is ready for use. The running speed of the diazocopying material is up to 3.4 m/min. The absorption agent consists of 1 kg of citric acid per 10 liters of water.

What is claimed is:

1. A process for developing a two-component diazocopying material, comprising the steps of:

providing a film of a mixture of ammonia and water flowing uniformly into the interior of an evaporation zone and being uniformly heated at the same time to release a developing gas in the evaporation zone;

providing a liquid developing solution in a sump zone;

evaporating a portion of said developing solution to produce a developing gas in said evaporation zone located above said sump zone;

passing the diazocopying material through a developing zone;

introducing said developing gas from said evaporation zone into said developing zone and contacting said diazocopying material with said developing gas in said developing zone;

maintaining the temperature in said developing zone at a level higher than the temperature at which the developing gas enters from said evaporation zone; and maintaining the temperature in said sump zone at a constant value without influencing the temperatures in the developing zone and in the evaporation zone; said constant value being at a level higher than the temperature in the evaporation zone but not exceeding the temperature in said developing zone.

2. A process as claimed in claim 1, wherein said developing solution comprises an aqueous ammonia-containing solution.

3. A process as claimed in claim 1, wherein the ambient temperature is from about 87°–90° C. in the developing zone, from about 83°–85° C. in the evaporation zone and from about 86°–90° C. in the sump zone.

4. A process as claimed in claim 1, wherein the temperature in the evaporation zone is adjusted by heat conduction from the developing zone.

5. A process as claimed in claim 1, comprising passing the diazocopying material at atmospheric pressure through a developing gas-atmosphere which is sealed off from the ambient atmosphere and which is comprised of an ammonia-steam mixture containing from about 15 to 25% by weight of ammonia; supplying the evaporation zone with from about 120–70 ml/h of ammonia; and passing the ammonia-steam mixture into the developing zone in a direction which leads away from the direction of travel of the diazocopying material.

6. A process as claimed in claim 5, comprising passing the ammonia-steam mixture uniformly in the form of a film into the evaporation zone and further comprising drawing-off ammonia and steam by suction both ahead of and behind the developing zone in the direction of travel of the diazocopying material.

7. An apparatus for carrying out a process for developing a two-component diazocopying material, comprising:

a developing chamber defining therein a developing zone;

means for transporting a diazocopying material through said developing chamber;

means associated with said developing chamber for maintaining a uniform temperature in the developing zone;

an evaporator positioned below and adjacent to said developing chamber for producing a developing gas, said evaporator comprising an evaporation zone positioned in a heat-transfer relationship with said developing chamber in such a way that the temperature in the evaporation zone is controlled by conduction from the developing zone to a temperature slightly less than the temperature in the developing zone, and a sump zone positioned directly below and opening into said evaporation zone for containing a developing liquid;

a conduit connecting said evaporator to said developing chamber for conveying developing gas from the evaporator into the developing zone; and means positioned at the bottom of said sump zone on said evaporator for heating said sump zone to a temperature which does not exceed the temperature in the developing zone.

8. An apparatus as claimed in claim 7, wherein the temperature difference between said evaporation zone and said developing zone is up to about 5° C.

9. An apparatus as claimed in claim 7, wherein said temperature maintaining means comprises a heater associated with said developing chamber, a temperature measuring device positioned in said developing zone and a control device for said heater which controls the heater in response to the temperature measured by said measuring device.

10. An apparatus as claimed in claim 9, wherein said sump zone heating means comprises a heater contiguous to the bottom of said sump zone and a control device responsive to the temperature in said developing zone.

11. An apparatus as claimed in claim 7, wherein said conduit leads horizontally from the evaporation zone into the developing chamber and comprises a slot on its bottom side.

12. An apparatus as claimed in claim 7, wherein said evaporator comprises a cylindrical shape, and further comprises a displacement body coaxially arranged in the cylindrical interior of the evaporator, the cylindrical surface of said displacement body being separated a distance d from the interior wall of the evaporator, said distance d being enough to allow evaporator liquid to form a film on the cylindrical surface so that the film passes uniformly downwardly into the evaporation zone.

13. An apparatus as claimed in claim 12, wherein the distance d is from about 0.5–5 mm.

14. An apparatus as claimed in claim 13, wherein the distance d is from about 1–3 mm.

15. An apparatus as claimed in claim 12, wherein said displacement body comprises an annular cut-out and an O-ring positioned in said cut-out and lying tightly against the interior wall of the evaporator.

* * * * *